US008323050B2

(12) United States Patent
Stantchev

(10) Patent No.: US 8,323,050 B2
(45) Date of Patent: Dec. 4, 2012

(54) CONNECTOR RETAINER SHELL

(76) Inventor: George Stantchev, Phoenix, AZ (US)

( * ) Notice: Subject to any disclaimer, the term of this patent is extended or adjusted under 35 U.S.C. 154(b) by 0 days.

(21) Appl. No.: 12/534,700

(22) Filed: Aug. 3, 2009

(65) Prior Publication Data

US 2011/0230087 A1 Sep. 22, 2011

(51) Int. Cl.
*H01R 13/73* (2006.01)

(52) U.S. Cl. ..... 439/553; 439/34

(58) Field of Classification Search ..... 439/34, 439/552–557, 347, 357; 200/296
See application file for complete search history.

(56) References Cited

U.S. PATENT DOCUMENTS 3,128,138 A * 4/1964 Noschese ..... 439/579
3,828,291 A * 8/1974 Urani ..... 337/201
4,124,267 A * 11/1978 Mines et al. ..... 439/553
4,227,060 A * 10/1980 Ayres et al. ..... 200/296
4,302,066 A * 11/1981 Newman et al. ..... 439/347
4,690,481 A * 9/1987 Randolph ..... 439/585
5,044,993 A * 9/1991 El-Haj et al. ..... 439/668
5,512,717 A * 4/1996 Magome et al. ..... 200/295
5,534,672 A * 7/1996 Meagher ..... 200/61.89
5,535,274 A * 7/1996 Braitberg et al. ..... 379/446
5,538,439 A * 7/1996 Fell et al. ..... 439/357
5,541,377 A * 7/1996 Stuhlmacher ..... 200/296
6,284,991 B1 * 9/2001 Fasano et al. ..... 200/296
6,305,986 B1 * 10/2001 Hwang ..... 439/607.44
6,547,585 B2 * 4/2003 Bradley et al. ..... 439/353
6,589,076 B1 * 7/2003 Davis et al. ..... 439/557
2008/0042393 A1 * 2/2008 Humphreys ..... 280/124.175

* cited by examiner

*Primary Examiner* — Renee Luebke
*Assistant Examiner* — Larisa Tsukerman

(57) ABSTRACT

A retainer shell used to install in a mounting hole on a device panel designed to accommodate electrical connector from an end of a standard extension harness. The retainer shell is designed to lock securely in an opening of the device panel without specialized tools to be required for such installation. The locking retainer shell is designed to have simple and reliable front panel push action installation and provide front panel interconnect to a mating cable assembly as example with the opposite mating gender.

5 Claims, 10 Drawing Sheets

CONNECTOR RETAINER SHELL

CROSS-REFERENCES TO RELATED APPLICATION

Field of the Invention

This invention relates generally to a shell enclosure designed to retain an electrical connector from one side of a standard extension harness to a panel. It is particularly pointing to a locking retainer shell accommodating off the shelf harness with mating connector retained in the shell attached to a panel allowing the main interface cable to attach to the mate connector at the panel.

BACKGROUND OF THE INVENTION

The popularity of the USB interconnect in mobile applications requires new low cost interface assembly to be developed suitable for installing aftermarket devices in reliable and aesthetic way. Many of these interfaces are designed for use in home and consumer electronic devices and are not suitable for mobile use as example automotive, biking, aviation and gym equipment markets.

In the existing interface panel installations there is no flexible and secure way for attaching a standard off the shelf harness assemblies with proper mating connectors to a panel. Let say for example if 3.5 mm audio jack needs to be installed to a panel an extension harness with the appropriate male to female jack can be used. The male side is interconnected to the equipment of choice and the female side should be installed at the panel.

There are number of ways known of attaching a female 3.5 mm stereo jack on a panel as example using a nut/thread assembly to secure the female audio jack connector portion to the panel. Although such installation may be proper for home or office entertainment equipment and not suitable in automotive environment where constant vibrations are present most of the time as well in many occasions the rear access to secure the nut is limited therefore the mentioned above installation is not practical.

An installation is even more demanding when it comes to USB and data connectors that now can be implemented in any environment to interface video, audio and data. There is no easy solution that can resolve the demand with minimum installation effort and meeting the automotive installation specifics.

The lack of retaining the standard interface cables as example audio and data cables is a particularly serious deficiency in the mobile and aftermarket applications because the standard peripheral connectors cannot be used in a reliable manner in the way they are used in a personal computer or home entertainment equipment.

As example invention from U.S. Pat. No. 5,895,289 shows custom locking piece that interlocks with custom over mold cable end. This invention requires a special over mold assemblies to accommodate the female USB side to a panel. This is requires custom made cables, multiple square holes precisely punched in a flat panel that is not easy to achieve in the automotive market.

Another prior art according U.S. Pat. No. 7,361,054 is showing entire connector assembly for a flange installation. The invention requires a complete connector modification and proposing a wing plate insert in a connector to allow panel installation.

Another prior art patent U.S. Pat. No. 7,094,099 shows a positive lock piece to hold the male side of USB A type connector in place in automotive application. The invention requires factory modifications, special housing and special tooling to install.

Another U.S. Pat. No. 7,438,602 Oct. 21, 2008 shows a multiple component connector assembly that replaces the cigarette lighter and requires a barrel with a nut lock and a custom female electrical USB connector assembly to be used. The female mating pins are custom part of the assembly designed to be replaced and fit to a custom cable harness.

Standard factory integration techniques have been used to accommodate various connectors for panel installation although so far there is no a simple practical and secure way to attach the widely used consumer USB extension cables or audio accessories to a panel with the aesthetics and the reliability the automotive market requires.

The connector retainer shell offered can be designed to accommodate any off the shelf extension harness end and is intended mainly for aftermarket vehicle device panel installation or home entertainment systems. The requirement set is that no special tools are required and the installation is done manually from the front side of the device panel as limited rear access and space is available most time on the field. Such invention provides new and practical method for accommodating the widely used consumer interface cables on a device panel.

Usually the design of the most common serial data interconnect cables is regulated by supervising institutions requiring general compliance. As example the mechanical and electrical regulations for High Speed Serial Bus (HPSB) known also as FireWire electrical and mechanical specification are regulated by the IEEE 1394 standard.

Regulations for USB interconnect can be found at the Universal Serial Bus Organization web site (www.usb.org). Those regulations address the mechanical housing design; coloring and labeling of all USB plug and receptacle assemblies which makes all the compliant harnesses interchangeable. Therefore creating a shell that will fit most of already available connectors is necessary and described in this invention.

Very often a custom design of USB connector interface for automotive aftermarket is not feasible due to the expense involved including design and certification, support and the installation inconsistencies when the installation have to be done across many different vehicle models.

The requirement set for the current invention to resolve is to use a standard off the shelf interface cables as example data (USB, HPSB) and multimedia (3.5 mm, RCA Jacks) and create a simple, aesthetic and reliable front side installation of a panel interface.

SUMMARY OF THE INVENTION

This invention provides an easy to install and inexpensive connector shell that is designed to fit around at least one off the shelf connector assembly and does not require modification to a standard electrical connector when used in a typical mating connection system.

The connector shell preferably comprises a single or split housing made of molded plastic that is installed securely around the end of a standard electrical connector harness. The connector shell merely requires no modifications to the terminal of the standard media or data connector which permits the connector shell to be securely mounted and retained on a panel with variable thickness. The connector shell may snap, lock or adhere onto a face panel to retain the mating terminals of the connection system securely on the panel.

ADVANTAGEOUS EFFECTS

The advantages of the invention are:

Accommodate existing extension cable end into a standard clam shell enclosure for panel installation;

Reliable and aesthetic device interconnect in automotive and mobile office environment;

Low cost solution suitable for aftermarket devices where the factory modifications are not available;

Simple and easy front side single piece push type installation;

Installation does not require specialized tools.

DETAILED DESCRIPTION OF EMBODIMENTS

Figure 1:
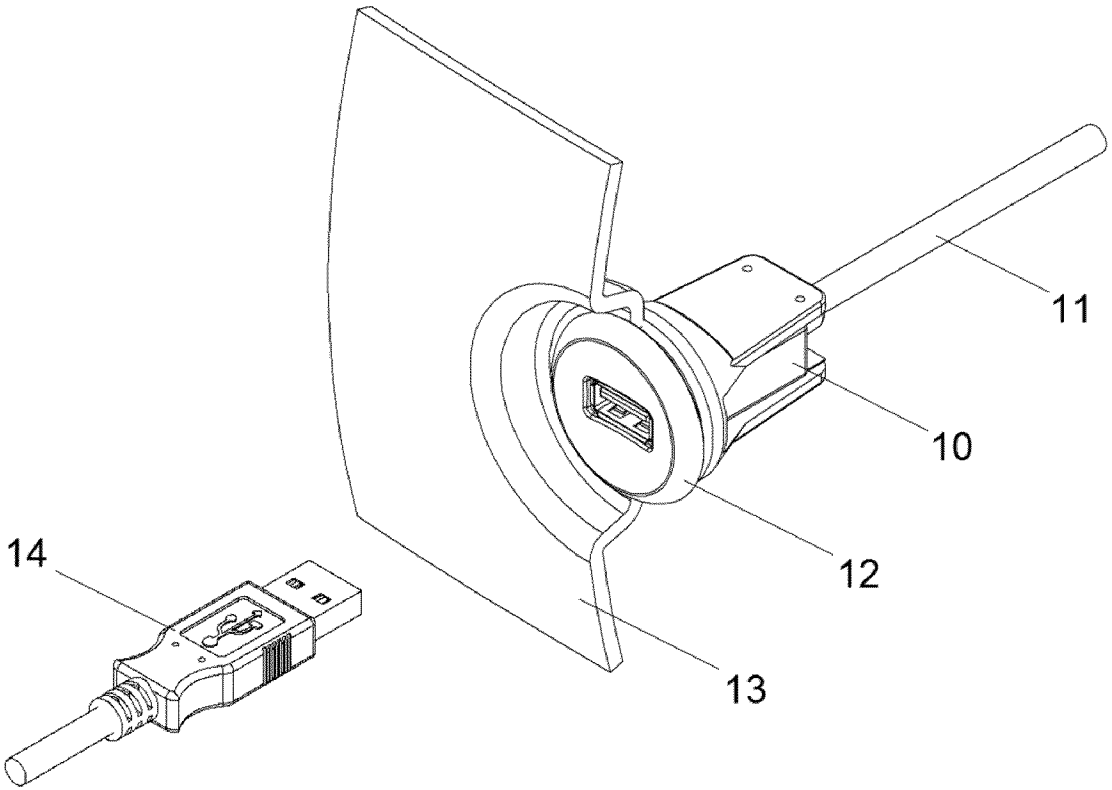
FIG. 1 is an assembled view of installed push type retainer shell accommodating USB electrical connection system in accordance with the invention.

The invention can be best understood if refer to the drawing shown at FIG. 1, it is installed view of a single piece push type retainer shell accommodating USB A type extension harness end according to the invention. More particularly, the electrical connection system shown at FIG. 1 accommodates a female connector side 10 of a standard USB A type extension cable harness 11 installed in a shell housing 12 mounted on a panel 13. The mating male USB A type plug 14 is attaching to the front panel side of the assembly.

The push type single retainer shell may be designed from soft rubber to snap in the opening with simple push action. That shell may have a section from one or both sides to allow easier installation of the dedicated harness end. Once the single piece retainer shell is in place the shell can accommodate the dedicated harness end.

Figure 2:
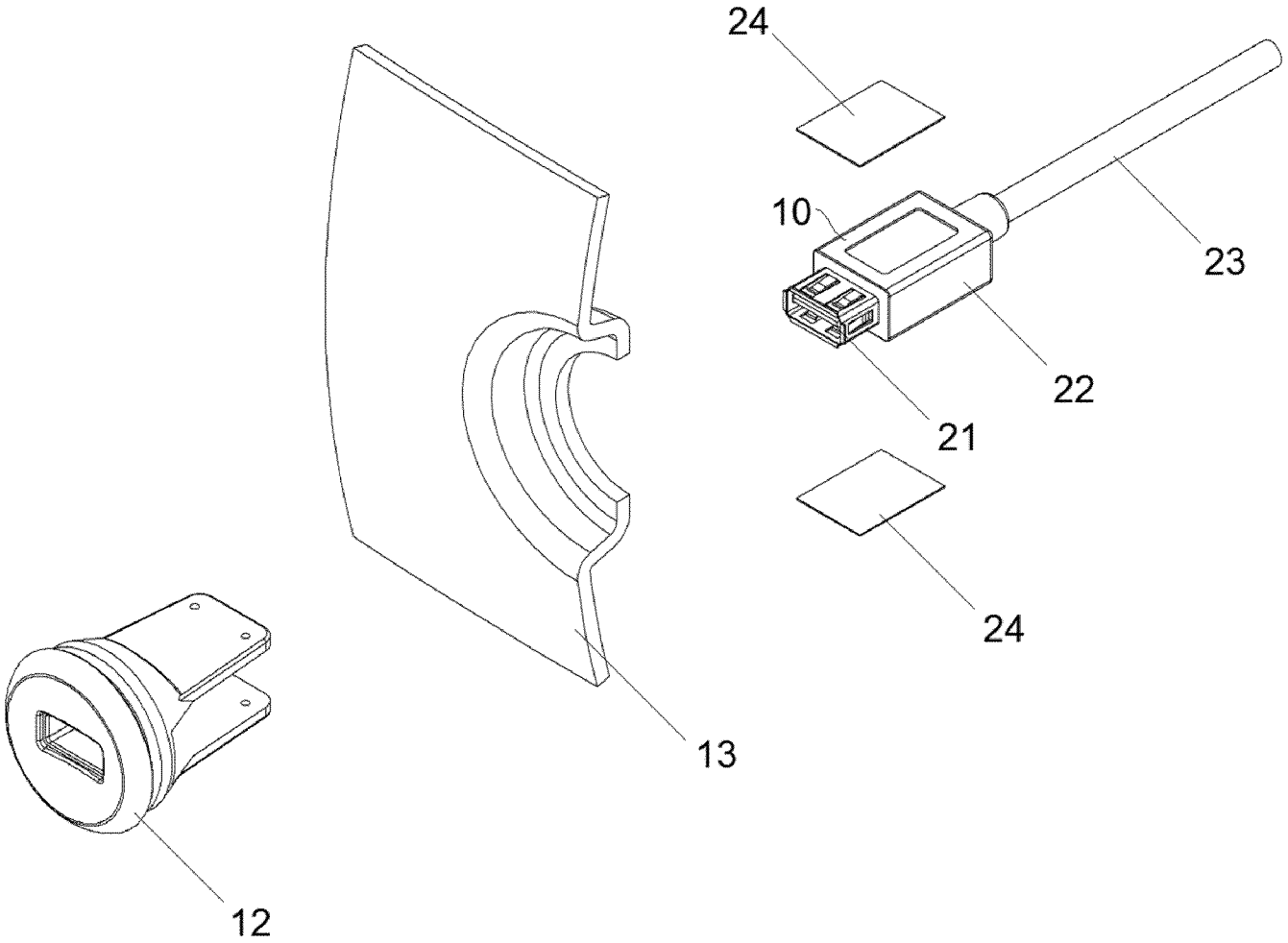
FIG. 2 is an exploded view of installed push type retainer shell accommodating USB electrical connection system secured with adhesive pads in accordance with the invention.

Referring to the next drawing shown at FIG. 2 it is an exploded perspective view of a single piece retainer shell designed to accommodate USB A type extension harness end. The connector 10 is a standard USB A type female socket connector with contacts 21 over-molded housing 22 and interface cable 23. To additionally secure the assembly glue or double side sticky pads 24 can be applied on both flat sides of the connector.

Figure 3:
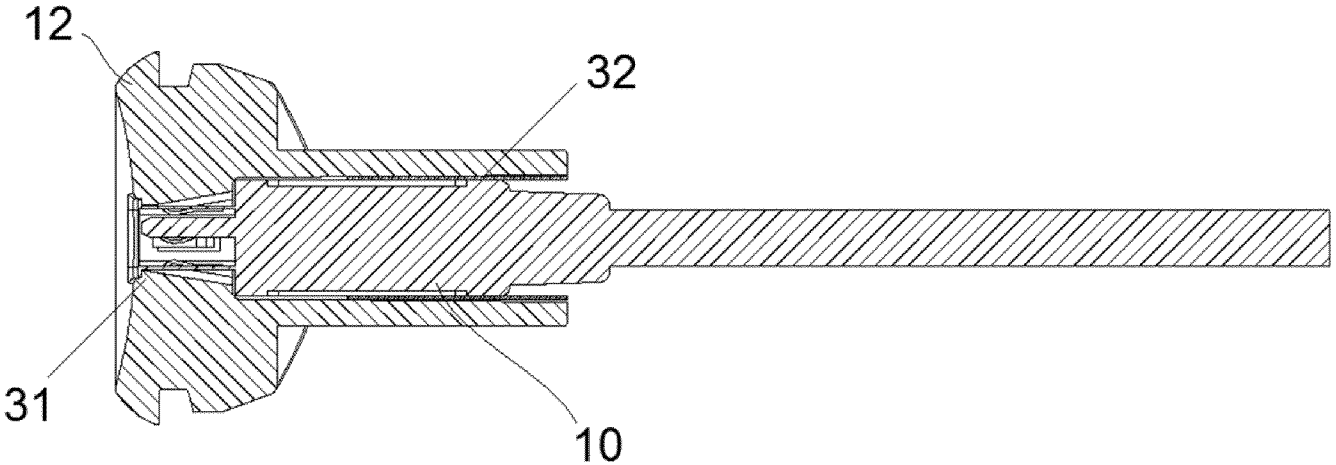
FIG. 3 is section view of the installed push type retainer shell accommodating USB electrical connection system referenced at FIG. 1 and FIG. 2.

The standard USB A type female connector side of the harness 10 is secured in the plastic retainer shell 12 by locking action as shown at FIG. 3. The lock is secured by the lip 31 shown on the sectioned view of the electrical connection system and may be sufficient to hold the connector in the shell. Glue 32 can additionally hold the assembly together.

Figure 4:
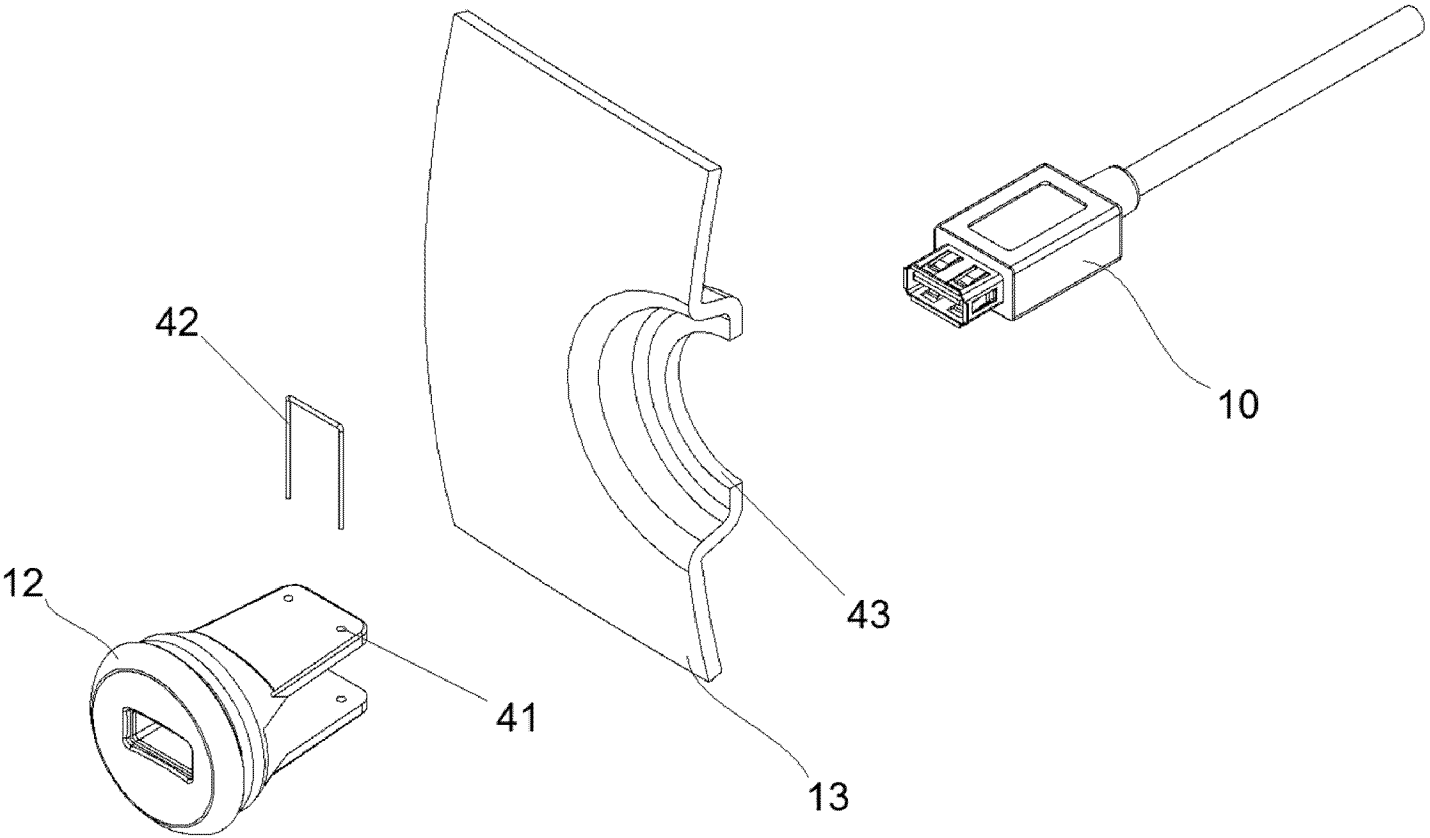
FIG. 4 is an exploded view of installed push type retainer shell accommodating USB electrical connection system secured with a clip in accordance with the invention.

Mounting holes 41 can be added to install clip 42 for better support action as shown at FIG. 4. The face panel 13 is the installation panel as example a vehicle front seat panel or dash board. Proper opening 43 is required to snap the push type retainer shell 12 into a place. As example the assembly may be fitted in a vehicle cigarette lighter opening or similar. Although modification of such opening may be necessary as example to a complete round hole or larger size.

Figure 5:
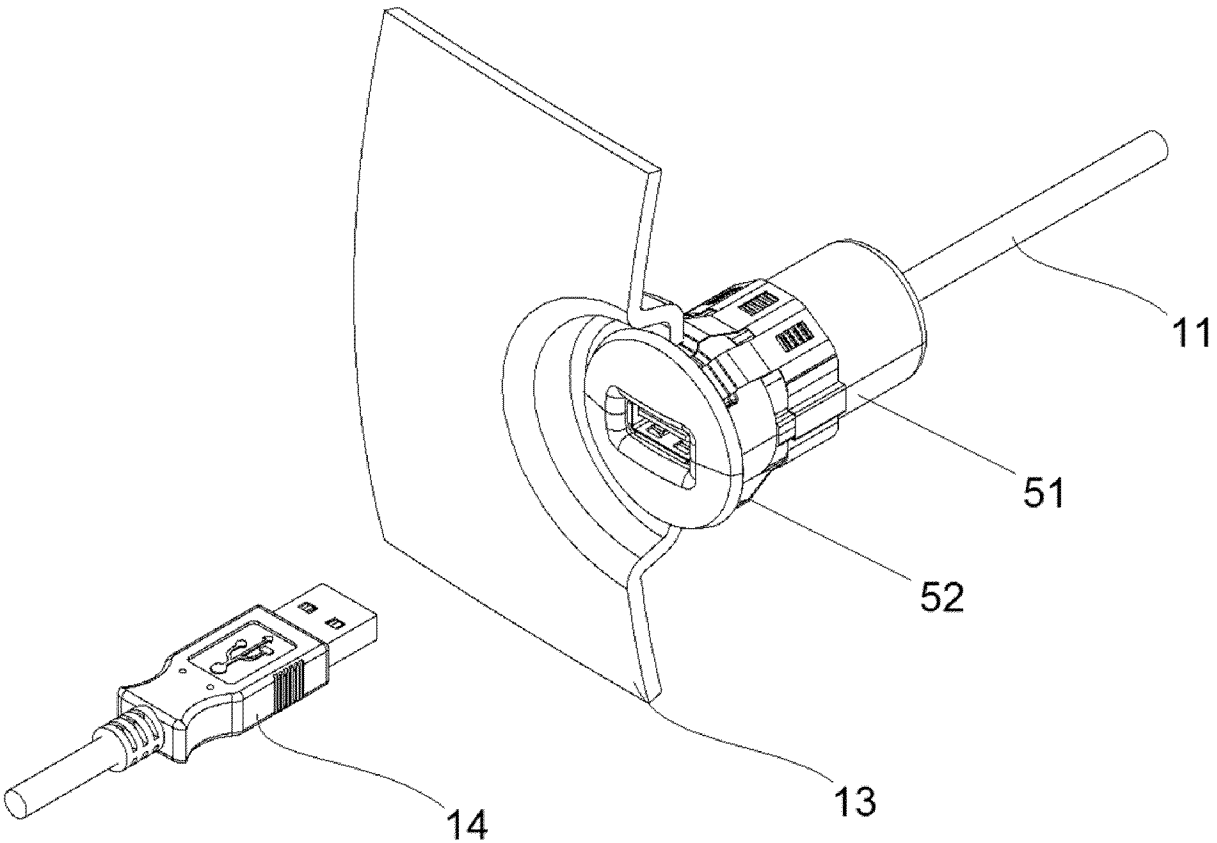
FIG. 5 is an assembled view of installed clip type retainer shell accommodating USB electrical connection system in accordance with the invention.

The assembly shown at FIG. 5 is installed receptacle end of a harness 11 in retainer shell 51 secured with the clip 52. The use of a clip 52 overcomes the nut/thread assembly concept that requires installation assess from both sides of the opening and significantly more operational space to accommodate a nut. The retainer shell is installed on the face panel 13 allowing front access of a USB Type A plug 14.

The advantages of using clip type retainer shell as shown at FIG. 5 are the easier assembly to can accommodate wider range of extension harnesses utilizing different female over mold connector shapes variations, better aesthetics and appearance using decorative plastic and a simple snap action onto a panel that accommodates different panel thickness variations. The clip connector shell 51 is designed to accommodate the USB A type receptacle side of the USB extension cable 11.

Figure 6:
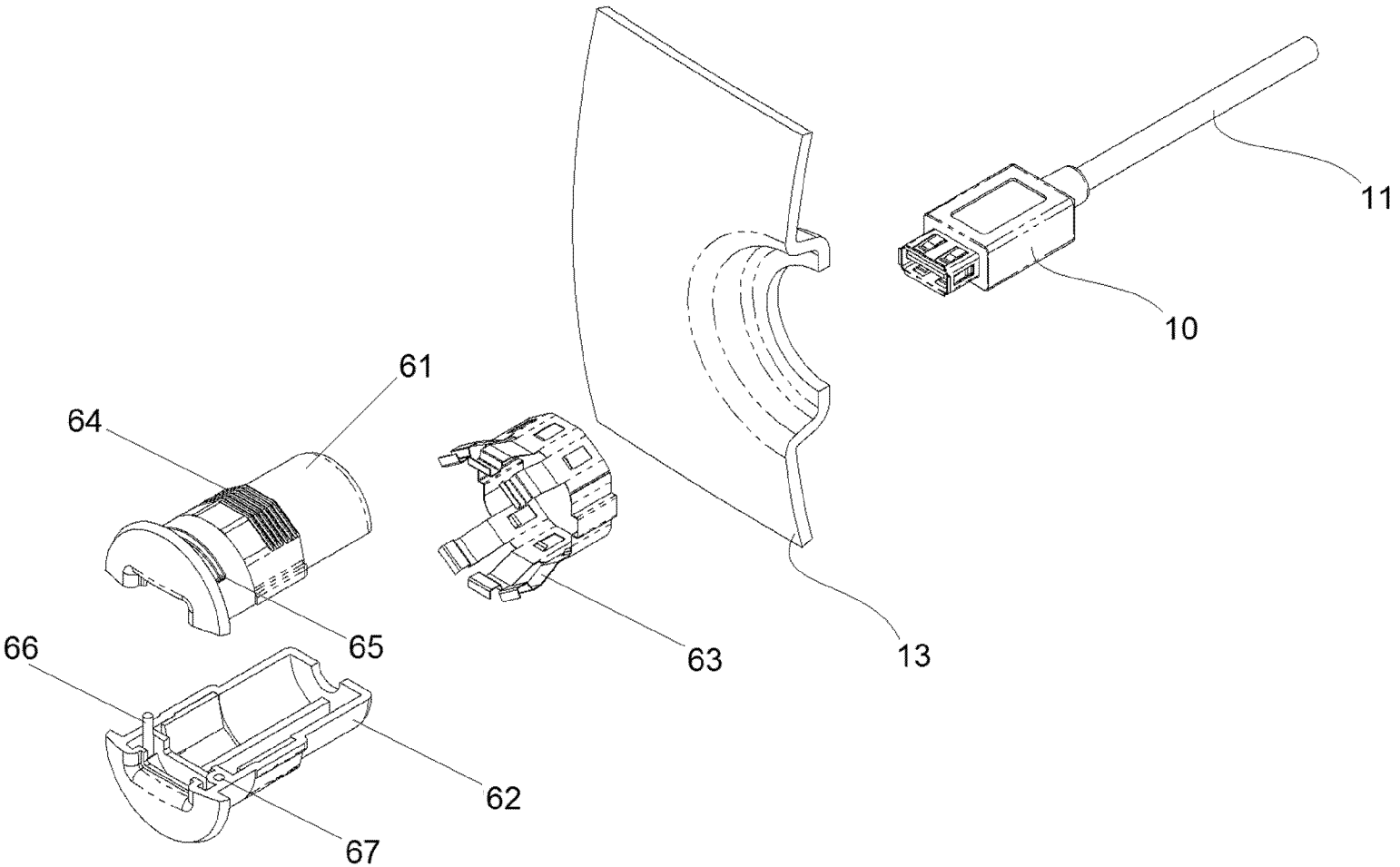
FIG. 6 is an exploded view of installed clip type retainer shell accommodating USB electrical connection system in accordance with the invention.

At FIG. 6 an exploded view of a clip type retainer shell is shown. The drawing shows USB A type female receptacle side of the extension cable 11 fitted between the top and the bottom shell pieces 61 and 62 and a stainless steel clip 63 installed to hold the assembly together. The top 61 and the bottom 62 pieces can be designed as one identical injection molded piece used twice in the assembly. They fit together in the assembly by aligning the post 66 with the mounting hole 67.

Further, the retainer shell pieces 61 and 62 may have ribs 64 to allow the stainless still clip to lock on them. The ribs 64 provide option for installing the clip at different position in reference to the shell flange. This way the assembly will accommodate different panel thicknesses. The cut off 65 is there to provide a spring effect on the clip lock 63 when the clip is installed on a panel.

Figure 7:
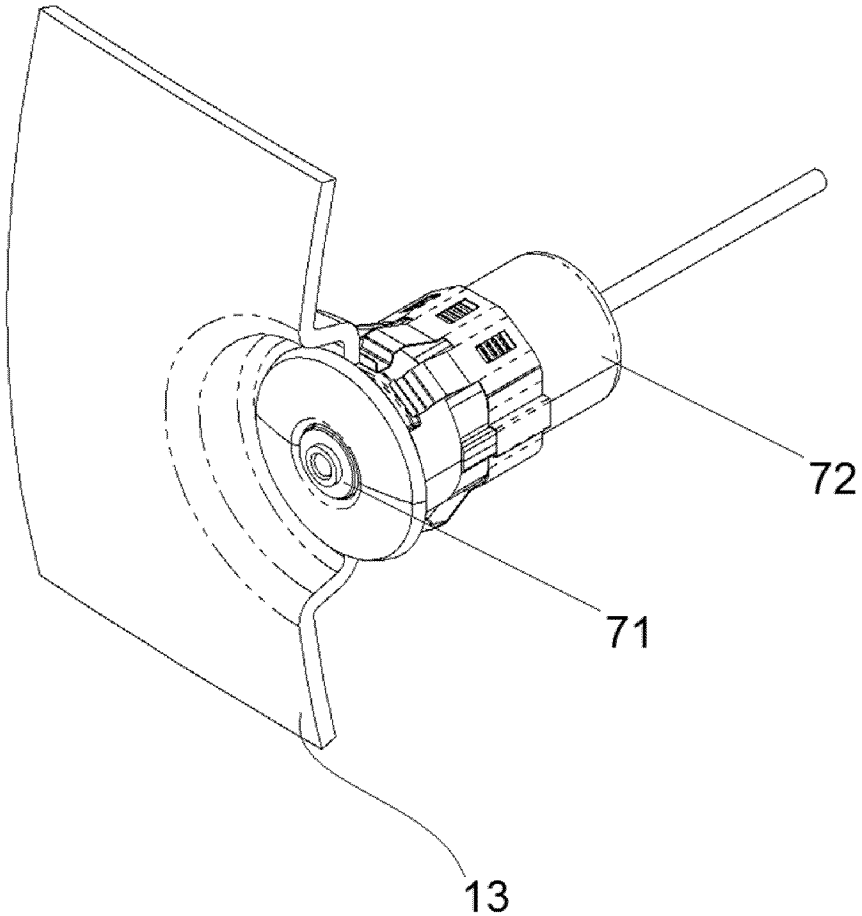
FIG. 7 is an assembled view of installed clip type retainer shell accommodating 3.5 mm Audio Jack electrical connection system in accordance with the invention.

The clip or push type connector retainer shells can be designed to accommodate various audio, video and data interfaces as example as shown at FIG. 7 clip type retainer shell for 3.5 mm Audio jack. The female audio jack receptacle 71 is installed into the audio jack connector retainer shell 72 mounted on a panel 13.

Figure 8:
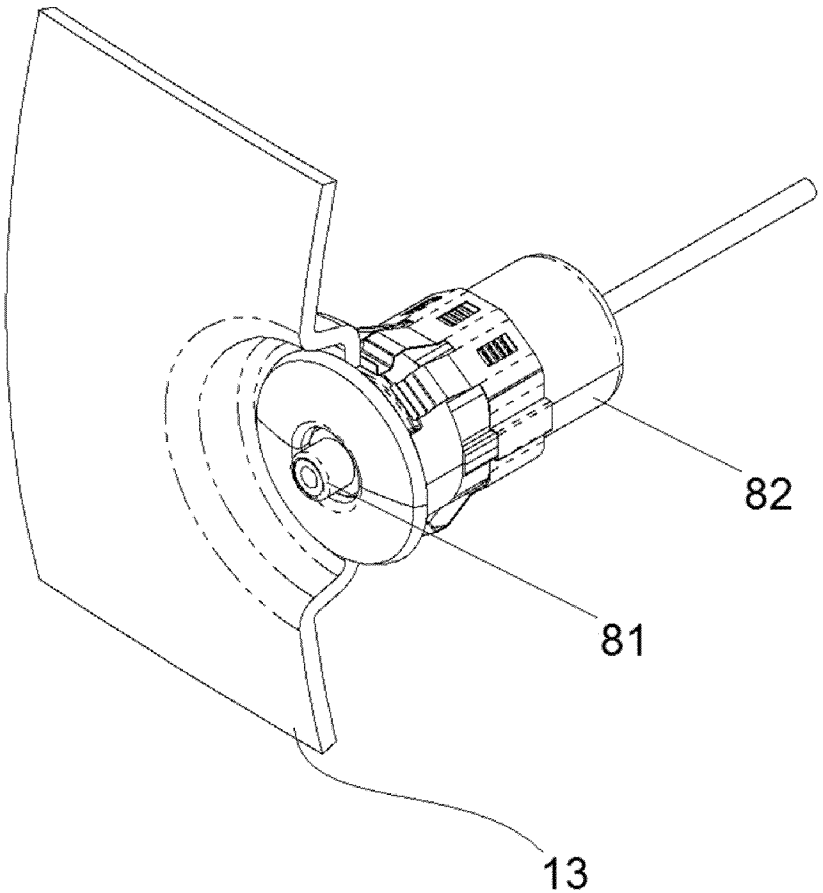
FIG. 8 is an assembled view of installed clip type retainer shell accommodating single RCA jack electrical connection system in accordance with the invention.

FIG. 8 shows a connector retainer shell accommodating RCA Audio/Video jack. The female RCA jack receptacle 81 is installed into the RCA jack connector retainer shell 82 mounted on a panel 13.

Figure 9:
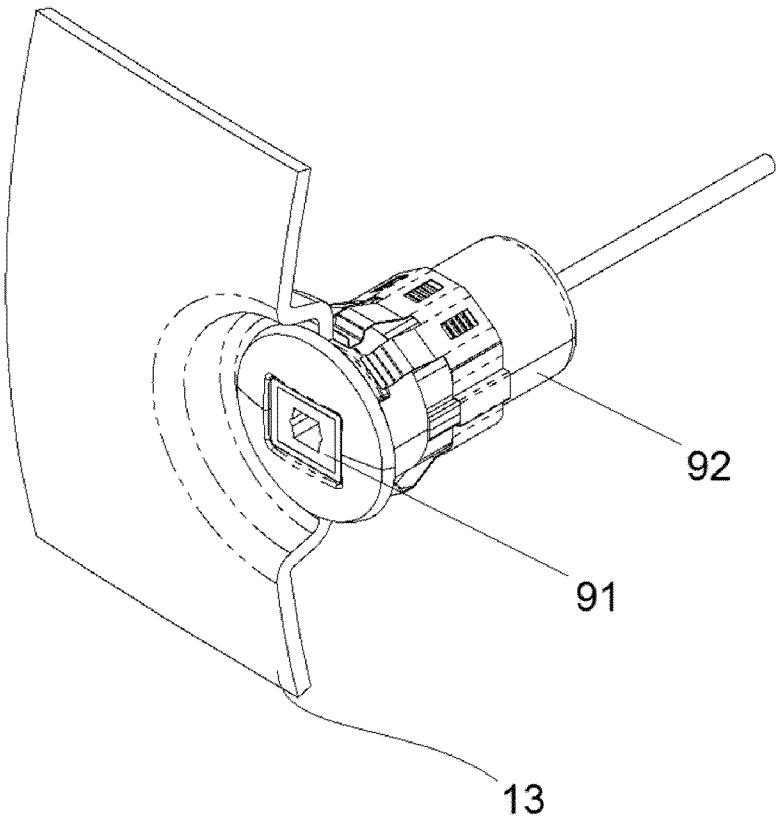
FIG. 9 is an assembled view of installed clip type retainer shell accommodating SPDIF electrical connection system in accordance with the invention.

FIG. 9 shows a connector retainer shell accommodating single SPDIF connector. The single SPDIF receptacle 91 is installed into the SPDIF connector retainer shell 92 mounted on a panel 13.

The retainer shell can be designed to accommodate multiple connectors together as example USB and audio jack harnesses, or RCA harness with dual RCA end, or dual SPDIF harness for data input and output. The installation opening that the current invention requires is a round opening that is easy to make with widely available tools. Such installation has significant advantages over the prior art showing square or multiple openings and requires multi-component assembly requiring rear panel access.

Figure 10:
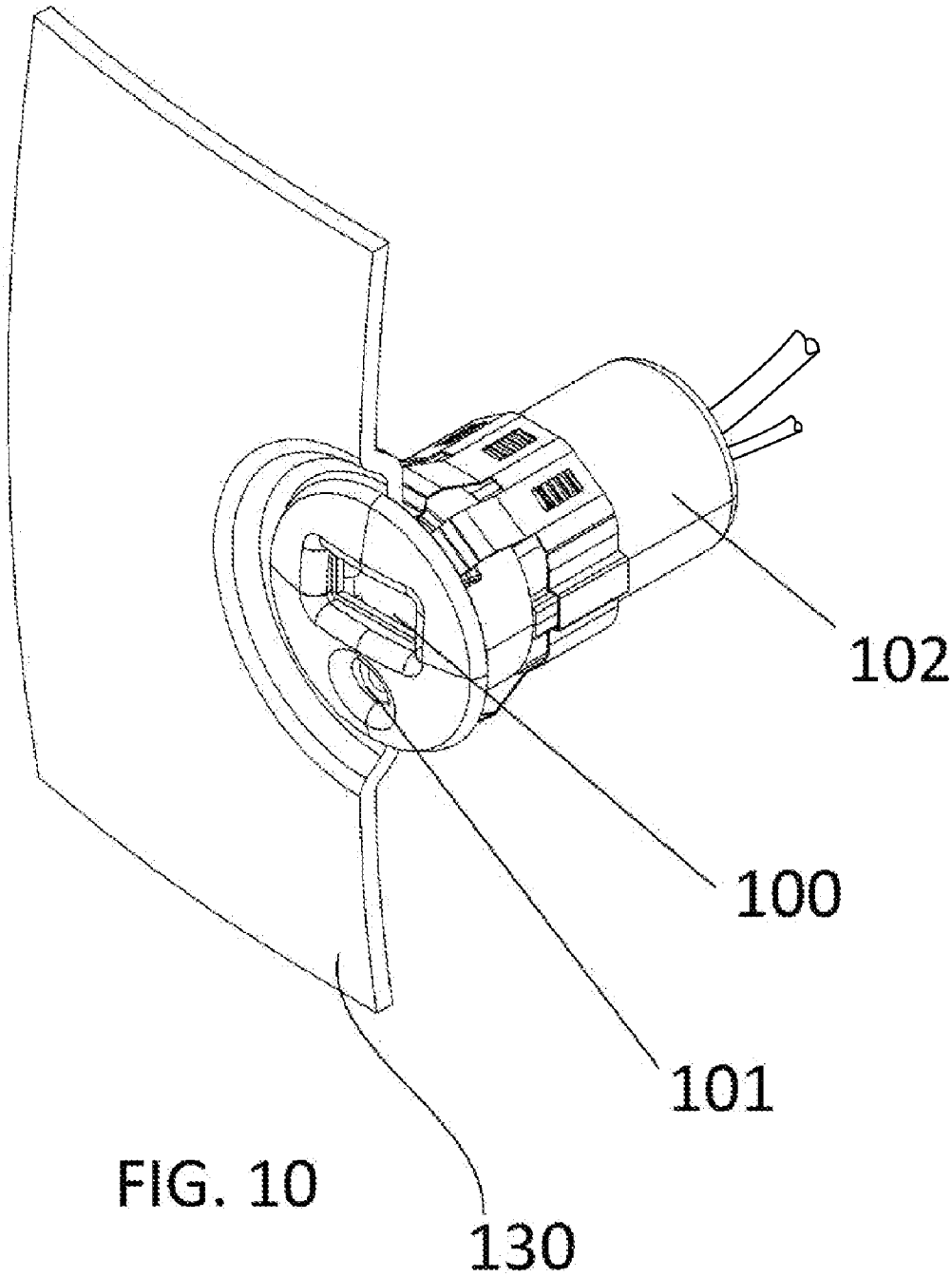
FIG. 10 is an assembled view of installed clip type retainer shell accommodating a plurality of electrical connectors in accordance with the invention.

The assembly shown at FIG. 10 has a first electrical connector 100 (e.g., a USB connector) and a second electrical connector 101 (e.g., an audio plug) mounted within a shell enclosure 102. Aside from having an internal configuration for receiving the first electrical connector 100 and the second electrical connector 101 (i.e., a plurality of electrical connector receiving cavities), the shell enclosure 100 has the same overall structural configuration as the assembly 51 shown at FIG. 5. In this regard, the shell enclosure 100 is mounted on face panel 130 in the same manner as the retainer shell 51 is mounted on the face panel 13.

It will be readily understood by those persons skilled in the art that the present invention is suitable for broad range of applications. Many embodiments and adaptations of the present invention other than those described above, as well as many variations, modifications and equivalent arrangements will be apparent from or reasonably suggested by the present invention and the foregoing description, without departing from the substance or scope of the present invention.

Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

I claim:

1. A retainer shell, comprising:

a shell enclosure; and a locking clip;

wherein said locking clip holds said shell enclosure together and locks said shell enclosure within a mounting hole on a device panel and said shell enclosure is designed to accommodate an electrical connector plug from a standard interconnect harness;

wherein said shell enclosure has multiple lips where said locking clip installs in order to accommodate different panel thickness; and wherein said shell enclosure has a cut off to allow a spring lock of said locking clip to lock the device panel.

2. The retainer shell of claim 1, wherein said shell enclosure consists of multiple pieces.

3. The retainer shell of claim 2, wherein each one of said multiple pieces is substantially identical and are engaged with each other to form said shell enclosure.

4. The retainer shell of claim 1, wherein:

the mounting hole is a car cigarette lighter opening; and said shell enclosure is at least one of shaped and sized to fit in a car cigarette lighter opening.

5. The retainer shell of claim 1, wherein said shell enclosure is designed to accommodate more than one electrical connector within said shell enclosure.

* * * * *